US010227159B2

(12) United States Patent
Jowett et al.

(10) Patent No.: US 10,227,159 B2
(45) Date of Patent: Mar. 12, 2019

(54) NESTABLE CONTAINERS HAVING NESTABLE LID ARRANGEMENTS

(71) Applicant: LOADHOG LIMITED, South Yorkshire (GB)

(72) Inventors: Leigh Jowett, South Yorkshire (GB); Matthew Bacon, South Yorkshire (GB)

(73) Assignee: LOADHOG LIMITED (GB)

( * ) Notice: Subject to any disclaimer, the term of this patent is extended or adjusted under 35 U.S.C. 154(b) by 2 days.

(21) Appl. No.: 15/193,532

(22) PCT Filed: Aug. 20, 2014

(86) PCT No.: PCT/GB2014/000323

§ 371 (c)(1),
(2) Date: Jun. 27, 2016

(87) PCT Pub. No.: WO2015/104521

PCT Pub. Date: Jul. 16, 2015

(65) Prior Publication Data

US 2016/0347501 A1 Dec. 1, 2016

(30) Foreign Application Priority Data

Jan. 10, 2014 (GB) ..... 1400437.8
Aug. 8, 2014 (GB) ..... 1414135.2

(51) Int. Cl.
*B65D 21/032* (2006.01)
*B65D 21/02* (2006.01)
(Continued)

(52) U.S. Cl.
CPC ..... *B65D 21/0233* (2013.01); *B65D 21/064* (2013.01); *B65D 43/163* (2013.01); *B65D 71/0096* (2013.01); *B65D 2251/1083* (2013.01); *B65D 2543/00194* (2013.01); *B65D 2543/00231* (2013.01); *B65D 2571/00055* (2013.01)

(58) Field of Classification Search
CPC .... B65D 21/064; B65D 21/04; B65D 21/068; B65D 21/062; B65D 21/06
See application file for complete search history.

(56) References Cited

U.S. PATENT DOCUMENTS 3,942,707 A 3/1976 Schidlowski et al.
4,325,492 A 4/1982 Kunze
(Continued)

FOREIGN PATENT DOCUMENTS

EP 0 204 208 12/1986
GB 2 289 884 12/1995
GB 2 471 969 1/2011

*Primary Examiner* — Stephen Castellano
(74) *Attorney, Agent, or Firm* — Clark Hill PLC; James R. Foley

(57) ABSTRACT

A container (10) comprises a base (12), upstanding walls (14) on the base and a lid arrangement (16) pivotally attacked to at least one of the walls at a hinge (17). The lid arrangement is pivotally moveable about the hinge from an open position to a closed position. When the lid arrangement (16) is in the open position, the container (10) can be nested within a similar further container having a similar further lid arrangement, and the lid arrangement (16) can be received within the further lid arrangement in a nested condition of the lid arrangements.

9 Claims, 11 Drawing Sheets

(51) Int. Cl.

| | |
|---|---|
| ***B65D 21/06*** | (2006.01) |
| ***B65D 71/00*** | (2006.01) |
| ***B65D 43/16*** | (2006.01) |

(56) References Cited

U.S. PATENT DOCUMENTS

| | | | | | |
|---|---|---|---|---|---|
| 4,688,675 | A | | 8/1987 | Miller et al. | |
| 4,765,480 | A | * | 8/1988 | Malmanger ..... | B65D 21/064 206/506 |
| 4,930,681 | A | | 6/1990 | Fultz et al. | |
| RE33,384 | E | * | 10/1990 | Miller ..... | B65D 21/064 206/508 |
| 6,318,586 | B1 | | 11/2001 | Frankenberg | |
| 2012/0048874 | A1 | | 3/2012 | Oakes et al. | |

* cited by examiner

NESTABLE CONTAINERS HAVING NESTABLE LID ARRANGEMENTS

RELATED/PRIORITY APPLICATION

This application is a National Phase filing regarding International Application No. PCT/GB2014/000323, filed on Aug. 20, 2014, which relies upon Great Britain Application Nos. 1400437.8 and 1414135.2, filed on Jan. 10, 2014 and Aug. 8, 2014, respectively, for priority.

This invention relates to containers. This invention also relates to container arrangements. Embodiments of this invention relate to containers with upstanding walls and at least one lid arrangement pivotally attached to the walls.

In order to ship empty containers, it is most efficient if they are nested within one another. Where the containers have lids that can pivot between open and closed positions, the lids need to be pivoted to the open condition alongside the walls in order for the containers to be nested. However, the footprint of the nested containers takes up a large amount of space, because the lids extend outwardly from the containers in their open position.

According to a first aspect of this invention, there is provided a container arrangement comprising: first and second containers, wherein each of the first and second containers comprises a base, upstanding walls on the base and a lid arrangement pivotally attached to at least one of the walls at a hinge, the lid arrangement being pivotally rotatable about the hinge from a closed position to an open position; wherein when the lid arrangement of the first container is in the open position, the second container can be nested within the first container; characterized in that the lid arrangement of each container is configured so that when so nested and when the lid arrangement of the second container is in the open position, the lid arrangement of the second container is aligned with the lid arrangement of the first container.

According to a second aspect of this invention, there is provided a container arrangement comprising: first and second containers, wherein each of the first and second containers comprises a base, upstanding walls on the base and a lid arrangement pivotally attached to at least one of the walls at a hinge, the lid arrangement being pivotally rotatable about the hinge from a closed position to an open position; wherein when the lid arrangement of the first container is in the open position, the second container can be nested within the first container; wherein each container and the container arrangement defines an open position footprint; characterized in that the lid arrangement of each container is configured so that when so nested and when the lid arrangement of the second container is in the open position, the open position footprint of the container arrangement is equal to the open position footprint of the first container.

As used herein, the phrase "open position footprint" is intended to be understood as follows. When the first container, or the container arrangement, is disposed on a horizontal support surface, the phrase "open position footprint" refers to the area on the support surface covered by the first container, or by the container arrangement, when the, or each, lid arrangement is in the open position.

According to a third aspect of this invention, there is provided a container arrangement comprising: first and second containers, wherein each of the first and second containers comprises a base, upstanding walls on the base and a lid arrangement pivotally attached to at least one of the walls at a hinge, the lid arrangement being pivotally rotatable about the hinge from a closed position to an open position; wherein when the lid arrangement of the first container is in the open position, the second container can be nested within the first container, and when so nested, the lid arrangement of the second container can be rotated about the hinge from a horizontal orientation by an opening angle of at least 260° to the open position.

The opening angle may be at least 265°. The opening angle may be at least 270°. The opening angle may be 260°. The opening angle may be 265°. The opening angle may be 270°. The lid arrangement may be configured so that it can be rotated about the hinge by the opening angle from the closed position to the open position. The horizontal orientation may be the closed position of the lid arrangement According to a fourth aspect of this invention, there is provided a container arrangement comprising: first and second containers, wherein each of the first and second containers comprises a base, upstanding walls on the base and a lid arrangement pivotally attached to at least one of the walls at a hinge, the lid arrangement being pivotally rotatable about the hinge from a closed position to an open position; wherein the lid arrangement of each container comprises a main member having opposite side regions, each side region extending from the hinge, and a wall member extending along each side region of the main member, the main member being configured to extend across the open top of the container when the lid arrangement is in the closed position; wherein when the lid arrangement of the first container is in the open position, the second container can be nested within the first container; characterized in that when so nested, and when the lid arrangement of the second container is in the open position, at least a portion of the main member of the lid arrangement of the second container can be received between the wall members of the lid arrangement of the first container.

When the lid arrangement of each container in the container arrangement is in the open position, the lid arrangements extend vertically downwardly from the side walls.

The embodiment of the invention described herein provides the advantage that the lid arrangements of all of the containers in the container arrangement extend vertically downwardly, thereby minimizing the amount of floor space occupied by each container arrangement. This allows more of the containers of the embodiment of the present invention to be stored or transported in the same space when not in use than prior art containers.

Thus, in the fifth aspect of the invention, the aforesaid portion of the lid arrangement of the second container can be nested within the first container. The lid arrangement of the first container may lie flush with the lid arrangement of the second container when the aforesaid portion of the lid arrangement of the second container is received between the wall members of the lid arrangement of the first container.

According to a sixth aspect of this invention, there is provided a container comprising a base, upstanding walls on the base and a lid arrangement pivotally attached to at least one of the walls at a hinge, the lid arrangement being pivotally moveable about the hinge from a closed position to an open position, wherein when the lid arrangement is in the open position, the container can be nested within a similar further container having a similar further lid arrangement, and the lid arrangement can be received within the further lid arrangement in a nested condition of the lid arrangements.

According to a seventh aspect of this invention, there is provided a container comprising a base, upstanding walls on the base and a lid arrangement pivotally attached to at least one of the walls at a hinge, the lid arrangement being pivotally moveable about the hinge from a closed position to an open position, wherein when the lid arrangement is in the open position, the container can be nested within a similar further container having a similar further lid arrangement, the lid arrangement comprising a main member having opposite side regions extending from the hinge, each side region having a proximal end adjacent the hinge and a distal end spaced from the hinge, wherein the distal end is offset inwardly relative to the proximal end.

The container may comprise first and second opposite upstanding walls. The container may comprise two lid arrangements, each being pivotally attached by respective hinges to the first and second upstanding walls of the container.

The, or each, lid arrangement may comprise accommodating formations, wherein the accommodating formations on the lid arrangement can accommodate the further lid arrangement of the further container.

The, or each, lid arrangement may include strengthening formations such as ribs. The accommodating formations on the, or each, lid arrangement may accommodate the strengthening formations on the further lid arrangement. The lid arrangement may comprise a main member, and the accommodating formations may comprise a step formation provided across the main member and extending lengthwise thereof.

Each lid arrangement may have a free edge spaced from the hinge. The free edge may be substantially opposite the hinge.

In one embodiment, each side region may comprise a first side portion and a second side portion. A shoulder formation may be provided between the first and second side portions, wherein the first side portion is offset inwardly from the second side portion. The first side portion may have the distal end. The second side portion may have the proximal end.

The first side portion may extend from the free edge of the lid arrangement to the shoulder formation. The second side portion may extend from the shoulder formation to the hinge. The first side portion may extend from the distal end to the shoulder formation. The second side portion may extend from the shoulder formation to the proximal end.

In another embodiment, each side region may be angled inwardly from the proximal end to the distal end.

The main member may comprise a first lid portion extending from the first step formation to the free edge of the lid arrangement. The main member may include a second lid portion extending from the first step formation towards the hinge. The first lid portion may be offset from the second portion to extend over the strengthening formations of the further lid arrangement.

The main member may further include a second step formation provided between the second lid portion and a third lid portion of the main member, the third lid portion extending from the second step formation towards the hinge. The second lid portion may be offset from the third lid portion, wherein the second lid portion can extend over the hinge of the similar further container. The strengthening formations may comprise ribs, which may extend lengthwise and/or widthwise across the main member.

The, or each, lid arrangement may include a respective wall member at each side region. The shoulder formations may be provided on the wall member, wherein the wall member comprises first and second wall portions offset from each other on opposite sides of the shoulder formation. The first wall portion may extend from the free edge to the shoulder formation, and may be offset inwardly from the second wall portion. The second wall portion may extend from the shoulder to the hinge. The first wall portion may be disposed inwardly of the second wall portion of the further lid arrangement when the lid arrangements are nested within each other.

At least one of the upstanding walls may define a locating recess for receiving an edge region of a capping arrangement. The, or each, upstanding wall may have a top edge, the locating recess being defined in the top edge. An example of a suitable capping arrangement is described in prior Patent Specification No: GB2402380, A Cap for Palletised Loads.

The container may comprise further upstanding walls extending between the first and second upstanding walls, each of which may define a locating recess to locate the capping arrangement therein. The further upstanding walls may comprise opposite third and fourth upstanding walls. The locating recess may be defined at a region extending from the first or second upstanding wall. In one embodiment, each of the further upstanding walls may define two locating recesses, each extending from a respective one of the first and second upstanding walls.

According to an eighth aspect of this invention, there is provided a container arrangement comprising an array of containers, each container being as described above, and a capping arrangement mountable on the containers when the containers are disposed adjacent each other, wherein each of the first and second containers has opposite upstanding walls, each upstanding wall defining a locating recess to receive an edge region of the load capping arrangement.

The array of containers may comprise first and second containers disposed adjacent each other. The container arrangement may further include a support arrangement, which may be a pallet, on which the array is disposed.

Each upstanding wall may have a top edge, and the locating recess may be defined in the top edge. Each container may comprise first and second upstanding walls to which the lid arrangements are attached. Each container may include third and fourth upstanding walls extending between the first and second upstanding walls. The locating recesses may be defined in the third and fourth upstanding walls. Each of the further upstanding walls may define two recesses, each extending from a respective one of the first and second upstanding walls.

An embodiment of the invention will now be described by way of example only, with reference to the accompanying drawings, in which.

Figure 12:
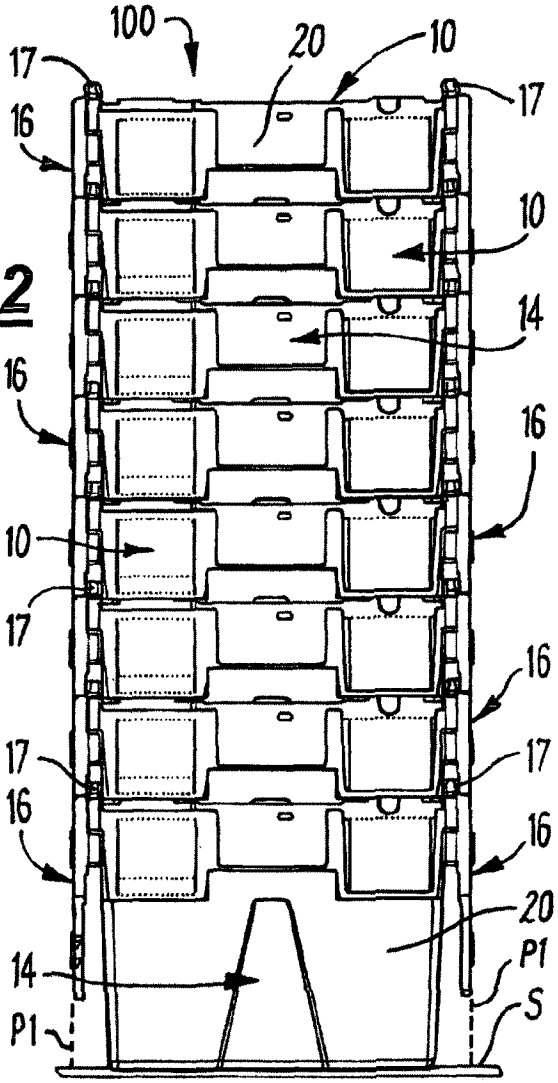
Figure 11:
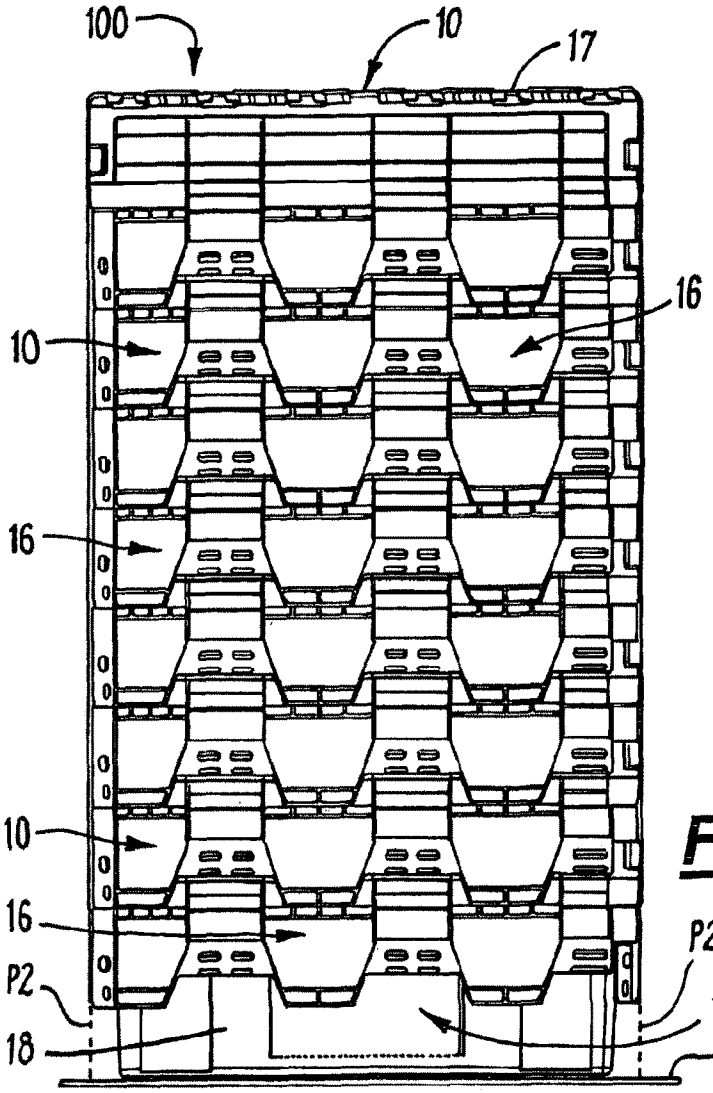
FIG. 11 is a side view of a container arrangement in the form of an array of nested containers, in which the array comprises seven containers.
Figure 13:
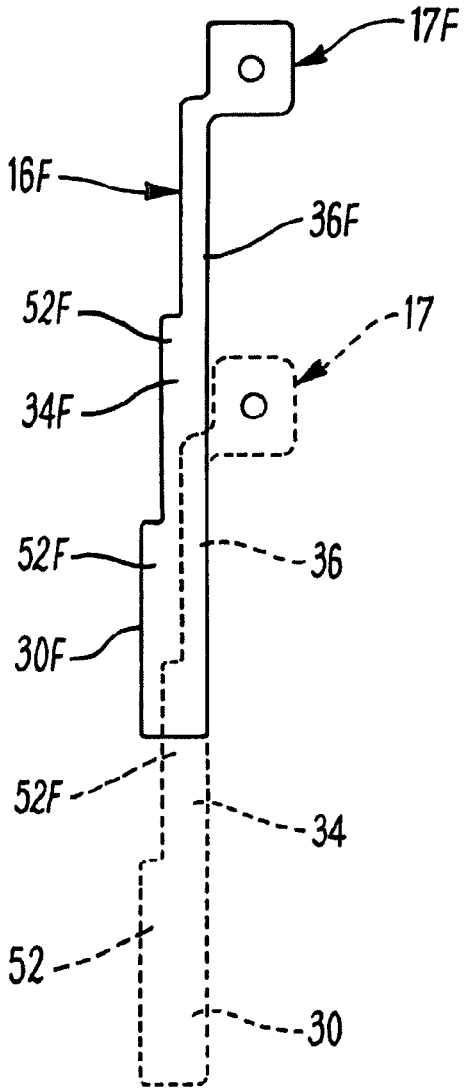

FIG. 12 is an end view of the container arrangement shown in FIG. 11; and FIG. 13 is a sectional side view of two lid arrangements of a further embodiment of a container arrangement FIGS. 1 to 7 of the drawings show a container 10 which comprises a base 12 and four upstanding side walls 14 on the base 12. The walls 14 comprise first and second opposite long walls 18. Each of the long walls 18 has a lid arrangement 16 pivotally attached thereto at a hinge 17 on the upper edge of the long wall 18. The walls 14 further include third and fourth opposite short walls 20 extending between the long walls 18.

Figure 3:
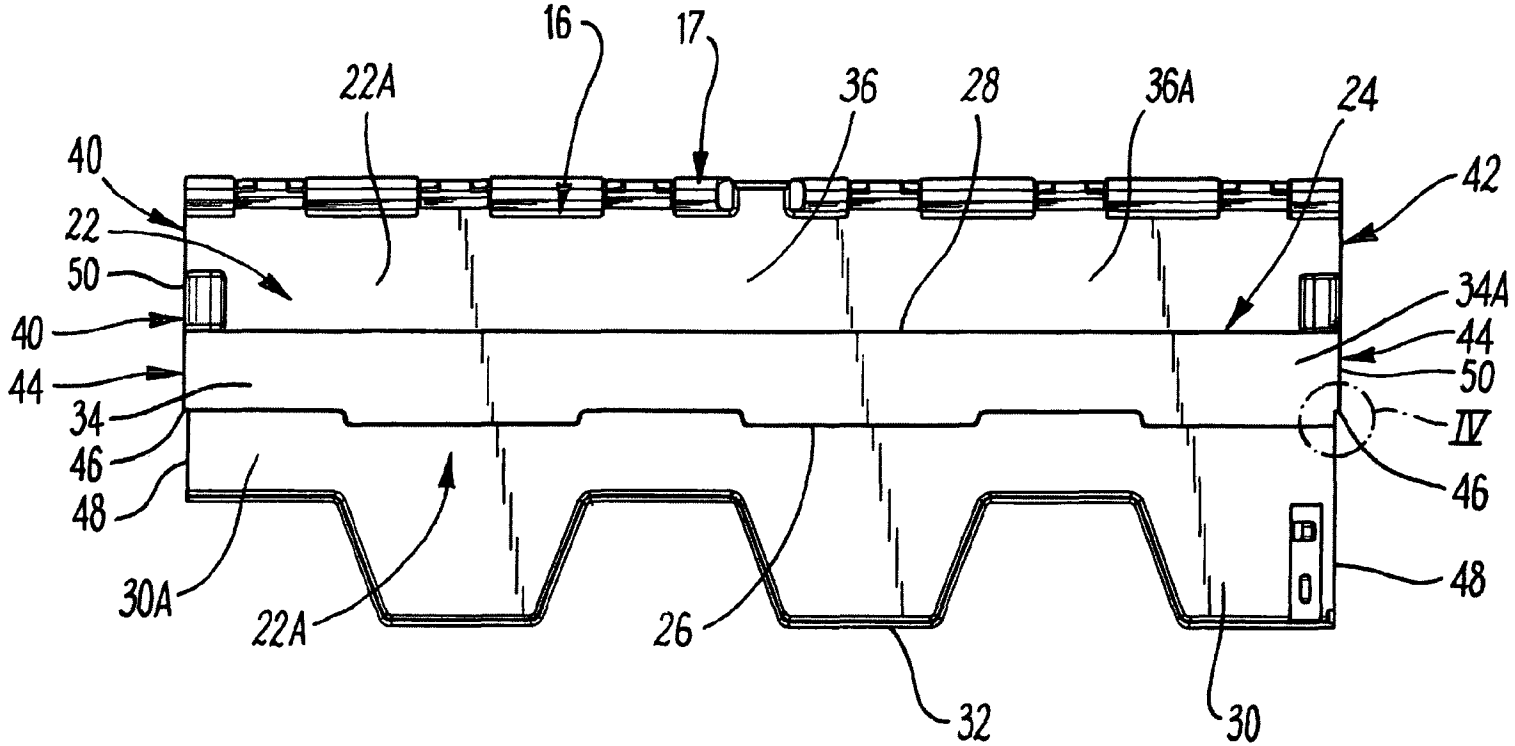
FIG. 3 shows a top view of a lid arrangement.
Figure 5:
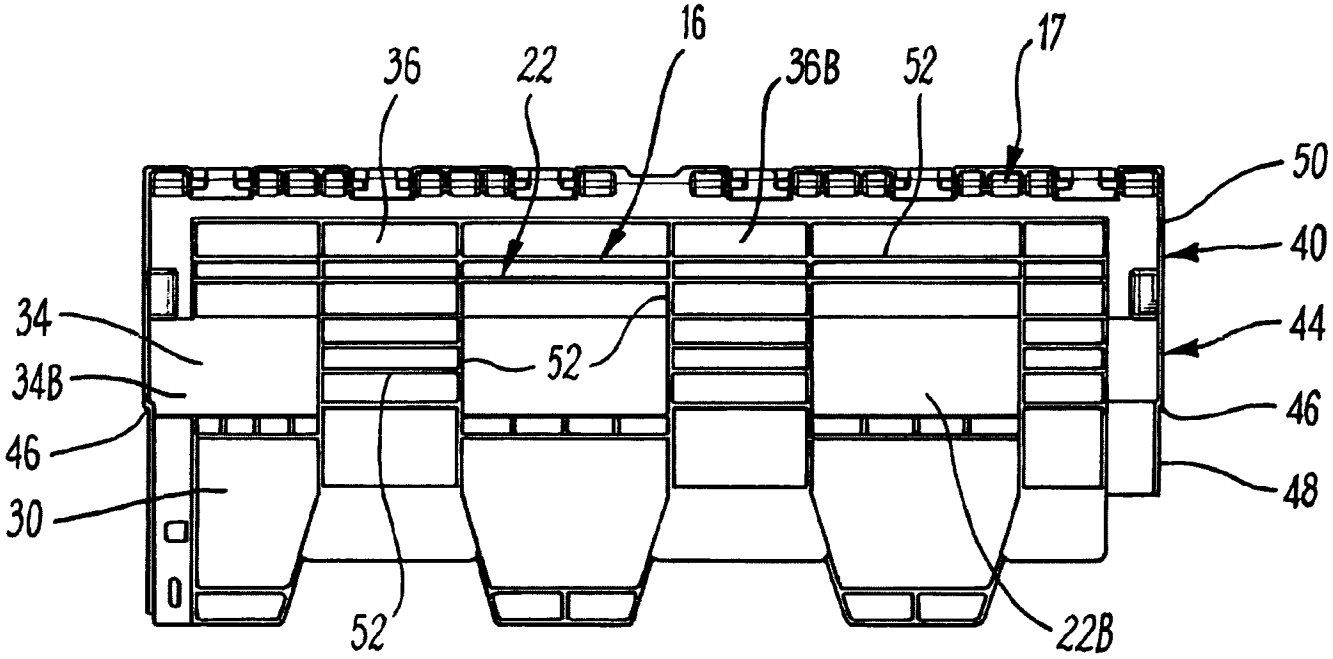
FIG. 5 is a bottom view of a lid arrangement.
Figure 6:
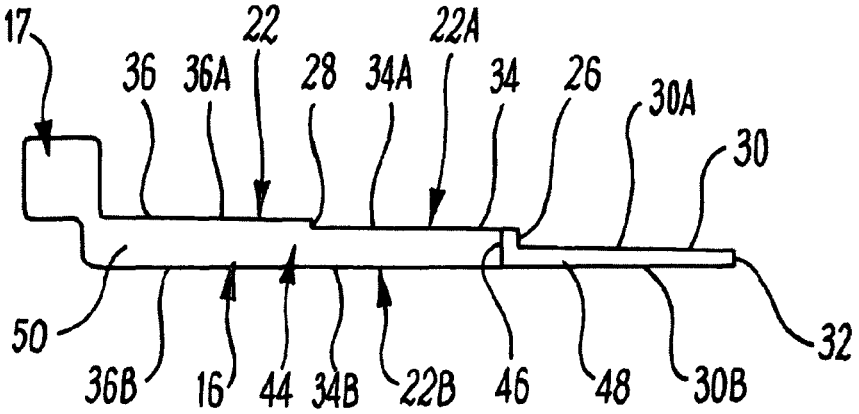
FIG. 6 is a side view of a lid arrangement.

Referring to FIGS. 3, 5 and 6, each of the lid arrangements 16 comprises a main member 22 and accommodating formations 24 thereon. The accommodating formations 24 comprise first and second step formations 26, 28 extending substantially parallel to each other along the length of the main member 22. The first and second step formation 26, 28 separate the main member 22 into three lid portions, namely, a first lid portion 30 extending from the free edge 32 of the lid arrangement 16 to the first step formation 26, a second lid portion 34 extending from the first step formation 26 to the second step formation 28, and a third lid portion 36 extending from the second step formation 28 to the hinge 17.

FIG. 6 shows diagrammatically a side view of one of the lid arrangements 16. The main member 22 has an upper face 22A and a lower face 22B. The expressions upper and lower faces are derived from the position of those faces when the lid arrangement is in its closed position extending horizontally.

The first lid portion 30 has a first upper face 30A and a first lower face 30B. The second lid portion 34 has a second upper face 34A and a second lower face 34B. The upper face portion 34A of the second lid portion 34 is offset upwardly at the first step formation 26 from the first upper face portion 30A of the first lid portion 30. The third lid portion 36 has a third upper face 36A and a third lower face 36B. The third upper face 36A is offset upwardly by the second step formation 28 from the second upper face portion 34A.

Figure 1:
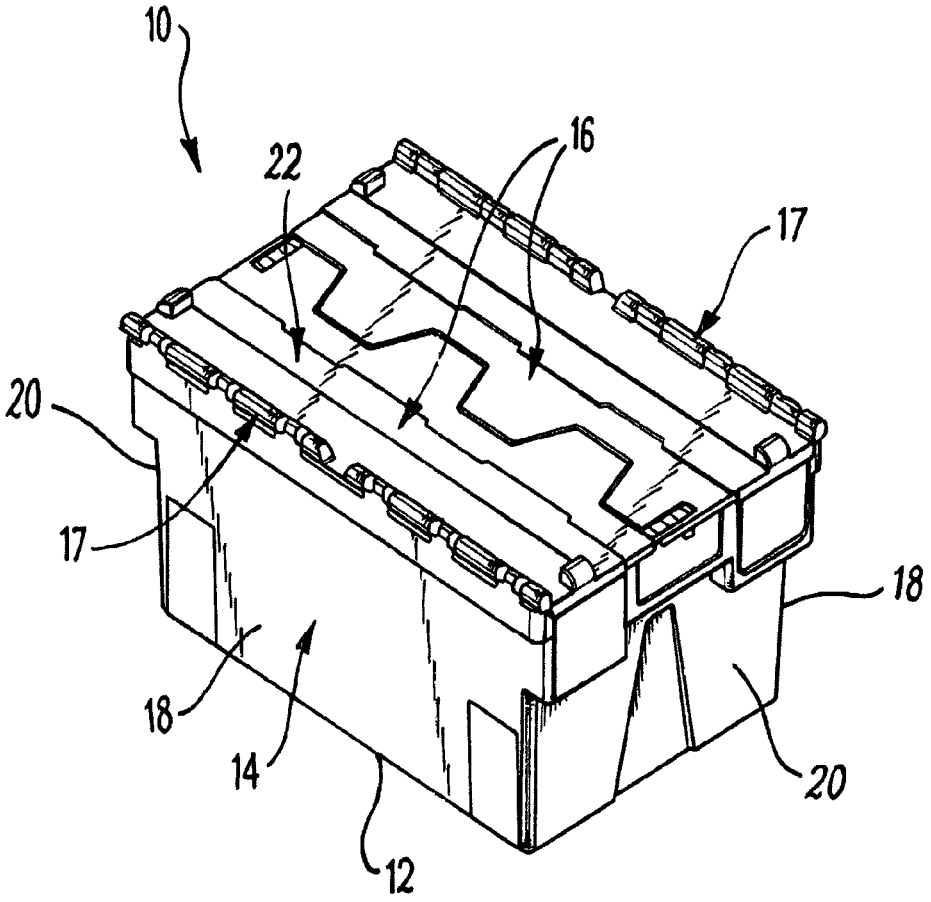
FIG. 1 is a perspective top view of a container.
Figure 2:
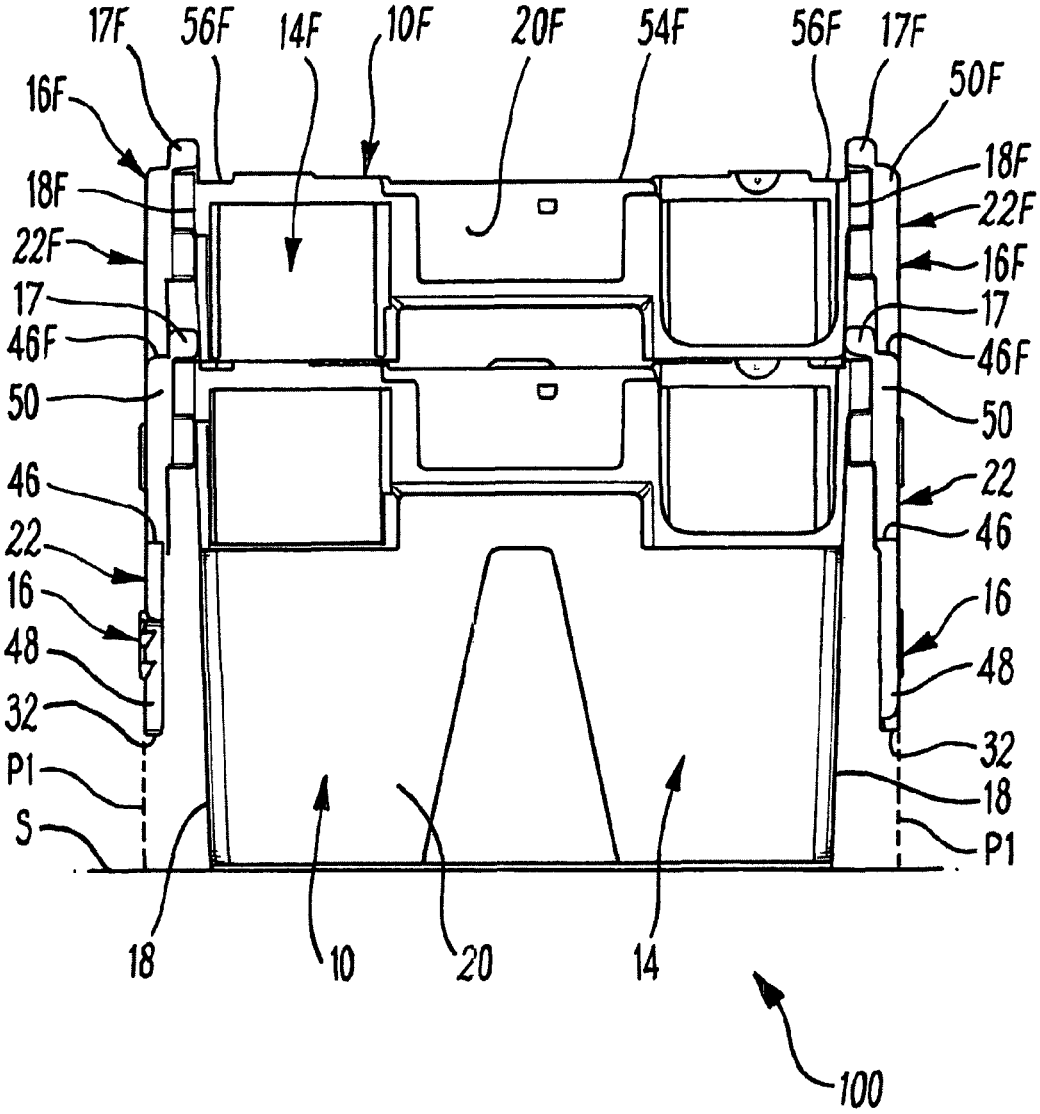
FIG. 2 is an end view of two nested containers, with the lid arrangements of the upper container being nested within the lid arrangements of the lower container.

Each lid arrangement 16 is pivotable about the hinge 17 from a closed position shown in FIG. 1 to an open position shown in FIG. 2. As can be seen from FIG. 2, when the lid arrangement 16 is in the open position, the lid arrangement 16 extends downwardly along the first or second wall 18 of the container 10.

The lid arrangement 16 also includes strengthening formations in the form of ribs 52 which extend lengthwise and widthwise along the main member on the lower face 22B thereof. The ribs 52 are shown more clearly in FIG. 5 and, as shown in FIG. 5, the ribs 52 extend across the second and third lower faces 34B, 36B. The lid arrangement 16 further includes opposite side regions 40, 42 at each of which a wall member 44 is provided. A further accommodating formation comprising a shoulder 46 is provided in the wall member 44 to separate the wall member 44 into first and second wall portions 48, 50 on opposite sides of the shoulder formation 46.

Figure 4:
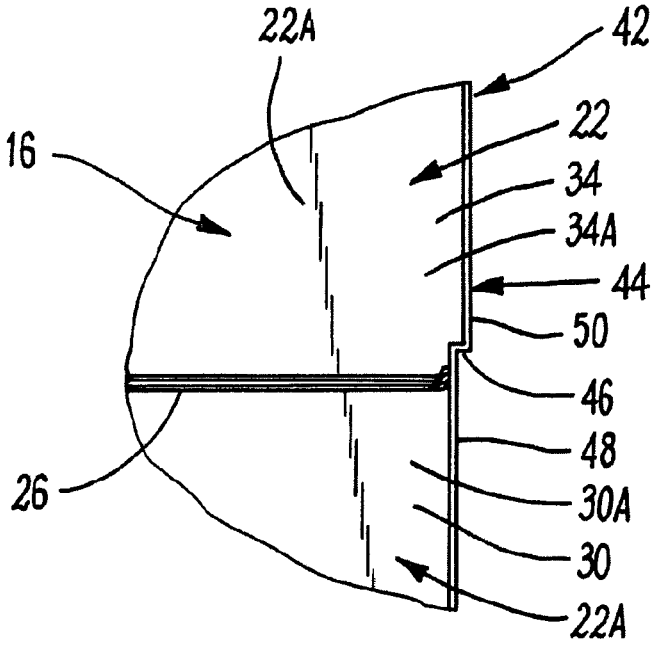
FIG. 4 is a close-up view of the region marked IV in FIG. 3.

As can be seen from FIGS. 4 and 5, the first wall portion 48 is offset inwardly relative to the second wall portion 50 at the shoulder 46. The purpose of the shoulder 46 is explained below.

FIG. 2 shows a container arrangement 100 in the form of an array comprising first and second nested containers 10, 10F, the second container 10F being nested within the first container 10. As can be seen from FIG. 2, the first container 10 is the lowermost of the two containers 10, 10F. The features of the second container 10F are the same as the features of the first container 10 and have been designated with the same reference numerals as the features of the container 10, but suffixed with a letter 'F'.

When the second container 10F is nested within the first container 10, as shown in FIG. 2, the lid arrangements 16F of the second container 10F can be aligned with the lid arrangements 16 of the first container 10 when the lid arrangements 16, 16F are in their open positions. When such alignment occurs, it will be seen that the first wall portion 48F of the wall member 44F of the second container is received between the wall portions 50 of the lid arrangement 16 of the first container 10. This is facilitated by virtue of the fact that the first wall portion 48F is offset inwardly by the shoulder formation 46F.

Thus, in the arrangement shown in FIG. 2, the lid arrangements 16F of the second container 10F are nested in the lid arrangements 16 of the first container 10.

The nesting of the lid arrangements 16F within the lid arrangement 16 of the first container 10 is further facilitated by the provision of the first and second step formations 26F, 28F of the lid arrangement 16F to accommodate the second and third further lid portions 34, 36 of the further lid arrangement 16, and to accommodate the ribs 52 on the second and third further lid portions 34, 36.

Figure 7:
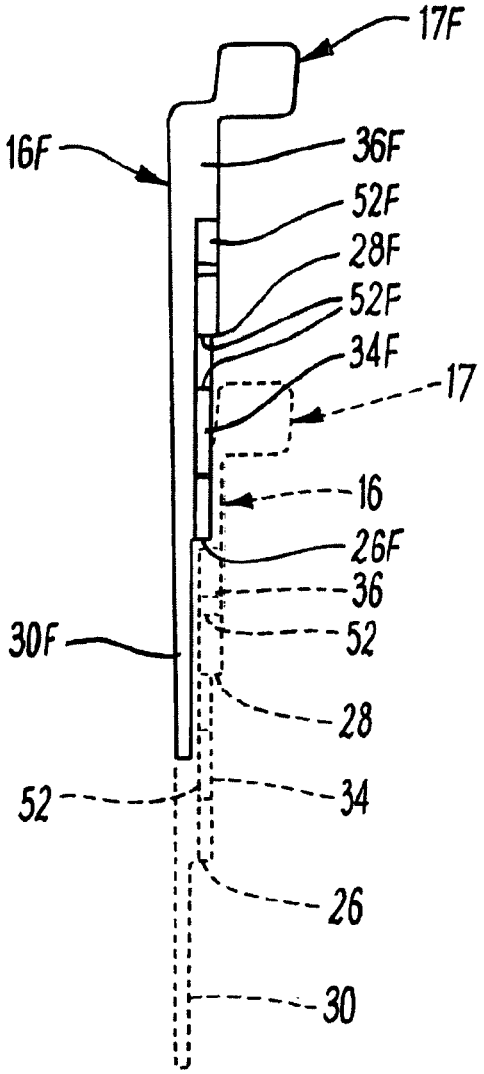
FIG. 7 is a sectional side view of two lid arrangements, one being nested within the other.

FIG. 7 shows two lid arrangements 16, 16F of a nested arrangement of containers. Each of the lid arrangements 16, 16F is in its open condition, and is thereby arranged vertically. In order for the lid arrangement 16F to be received within the further lid arrangement 16 in a nested condition, both lid arrangements 16, 16F are disposed in their open positions, and the second container 10F nested within the further first container 10 (see FIG. 2).

The lid arrangements 16F are then rotated about the hinge 17F from the closed position (see FIG. 1), in which the lid arrangements 16F are disposed parallel to the base 12 and, when the container arrangement 100 is disposed on a horizontal support surface S, the lid arrangements 16F are arranged horizontally in their closed position. The movement of the lid arrangements 16F to the open position, shown in FIG. 2 from the closed position is a rotation about the hinge 17F about an opening angle of 270°.

As can be seen from FIG. 2, the lid arrangement 16F of the second container 10F has a footprint on the support surface S that is the same as the footprint of the first container 10. The footprint on the support surface S is indicated by the broken lines P1 extending to the support surface S from the free edges 32 of the lid arrangements 16 of the first container 10. As shown in FIG. 2, the lid arrangements 16, 16F, being in their open position, extend vertically. FIG. 2 shows that the footprint defined by the lines P1 for the first container 10 with its lid arrangements 16 in the open position is the same as the footprint of the second container 10F also with its lid arrangements 16F in the open position, This provides the advantage in the embodiment shown that the nested array of containers 10 occupies the same floor space as a single container, regardless of the number of containers 10 in the array 101 and, therefore, occupies less floor space than prior art nested container arrays.

The third portion 36F of the lid arrangement 16F extends downwardly from the hinge 17F towards the hinge 17. The second step formation 28 allows the second lid portion 34F to extend over the hinge 17 to be received within the third lid portion 36 of the further lid arrangement 16.

The first step formation 26F allows the first lid portion 30F to extend over the ribs 52 and be received within the second lid portion 34 of the first container. As a result, it will be seen from FIG. 7, that the lid arrangements 16, 16F are aligned with one another. It will be understood by those skilled in the art that this can be repeated with any suitable number of containers to provide an array of a plurality of nested containers 10 with their lid arrangements also nested within one another to minimise the space occupied by the nested containers.

Referring again to FIG. 2, each of the third and fourth opposite upstanding walls 20F of the second container 10F has a top edge 54F. The top edge 54F of each of the third and fourth upstanding walls 20F defines a pair of locating recesses 56F extending from the adjacent first or second upstanding walls 18F.

Figure 8:
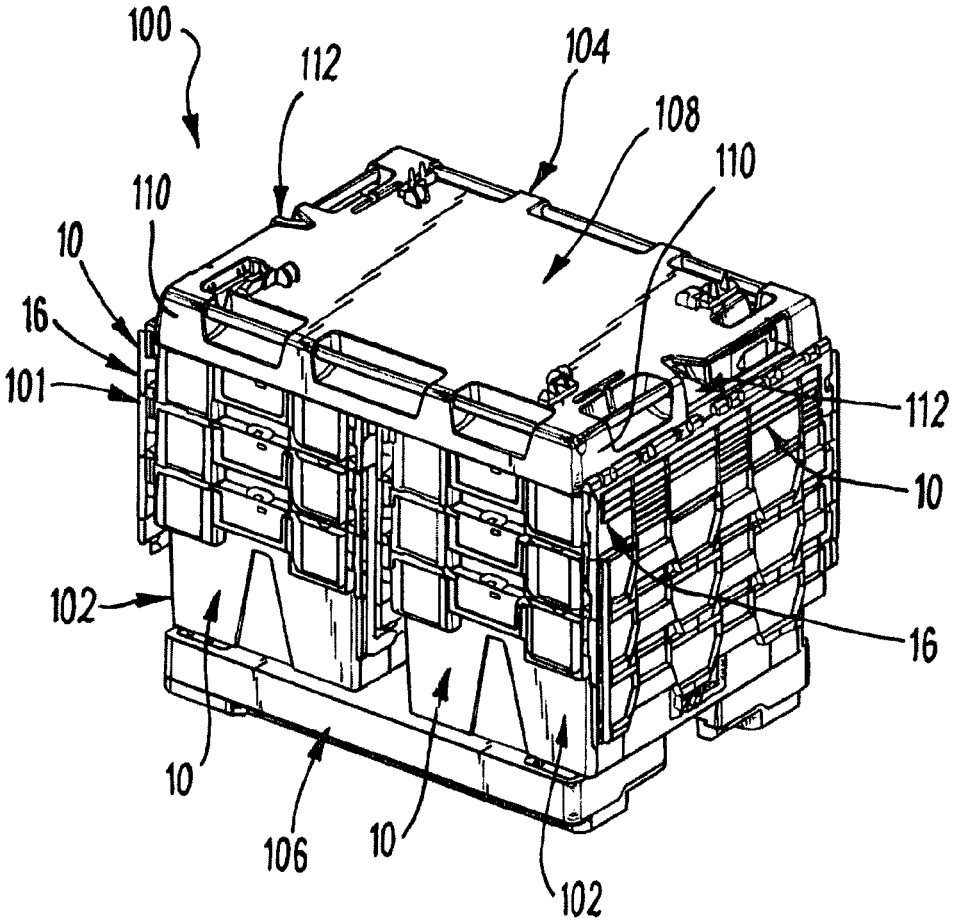
FIG. 8 is perspective view of a container arrangement.
Figure 9:
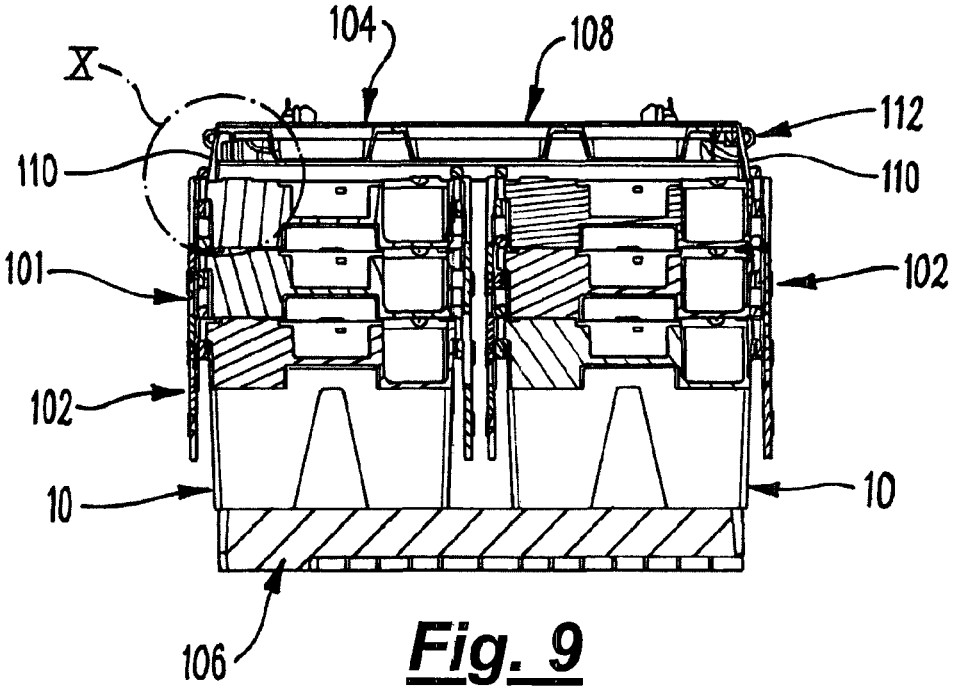
FIG. 9 is a part sectional front view of the container arrangement shown in FIG. 8.
Figure 10:
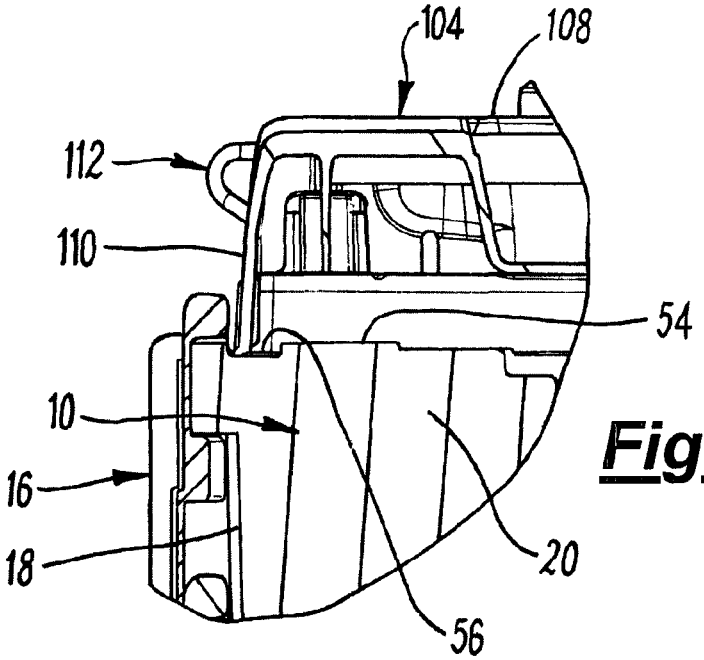
FIG. 10 is a close up view of the region marked X in FIG. 9.

FIGS. 8 to 10 show a further container arrangement 100 comprising an array 101 of three nested containers 10. In FIG. 8, the array 101 comprises two sets 102 of containers 10, each set 102 comprising three nested containers 10. It will be appreciated that each set 102 could comprise any suitable number of nested containers 10.

If desired, the container arrangement 100 may further include a capping arrangement 104 located on the top of the array 101. The capping arrangement 104 can be, for example as described in GB2402380, which is incorporated herein by reference. The capping arrangement 104 is provided to secure the array 101 to a pallet 106 on which the array 101 is disposed.

The purpose of the locating recesses 56 is to locate the capping arrangement 104 on the array 101. The capping arrangement 104 has a main part 108 and a plurality of downwardly extending edge members 110 on the main part 108. The capping arrangement also includes securing means 112, which comprise straps provided with hooks for engaging the pallet.

The securing means 112 further includes mechanisms housed within the main part 108 for tightening the straps when the hooks engage the pallet, and for retracting the straps. The securing means is described in more detail in GB2402380.

The capping arrangement 104 is disposed on the upper containers 10 of each set 102. The lid arrangements 16 of the upper containers are in their open position, and the capping arrangement 104 is disposed on the upper containers 10 so that the edge members 110 are received by, and located in, the locating recesses 56 in the upper edge 54 of the third and fourth upstanding walls 20.

The provision of the locating recesses allows the capping arrangement 104 to secure the containers 10 in the array 101 to one another and to the pallet 106 upon which they are disposed. This can be advantageous when it is desired to transport an array of nested containers on a pallet; the capping arrangement can be disposed on the uppermost containers of the array, and can secure the array to the pallet.

Notwithstanding the above, it will be appreciated that a capping arrangement could be provided on an array 101 that is not disposed on a pallet.

FIGS. 11 and 12 show a further container arrangement 100 which comprises an array of seven containers 10 nested within one another, as shown. It will be appreciated that any suitable number of the containers 10 could form the container arrangement 100. Each of the lid arrangements 16 is in the open position. The lid arrangements 16 of the lowermost container 10 extend vertically downwardly from the hinges 17. The lid arrangements 16 of each of the other containers 10 also extend vertically downwardly by virtue of being aligned with the lid arrangements 16 on the corresponding sides of the lowermost container 10.

As shown in FIGS. 11 and 12, the footprint of the container arrangement 100 is defined on the surface S by the area between the broken lines P1 in FIG. 12, and the broken lines P2 in FIG. 11. The broken lines P1 in FIG. 11 are the same as the broken lines P1 in FIG. 2. As can be seen from FIGS. 11 and 12, the footprint of the whole container arrangement 100 is the same as the footprint of the lowermost container There is thus described a container arrangement 100 comprising a plurality of nested containers 10, where the lid arrangements 16 of all of the containers 10 lie substantially in a substantially straight line, thereby ensuring that the lid arrangements 16 extend outwardly from the walls 18 no further than the lid arrangements 16 of the lowermost container 10. There is also described a container 10 having a lid arrangement configured so that when a plurality of the containers 10 are disposed in a nested array, the lid arrangements of each container 10 are nested within each other, thereby extending in a substantially straight line.

Various modifications can be made without departing from the scope of the invention. For example, the container arrangement may comprise any suitable number of sets 102 of nested containers 10, which may be arranged in a 2×2 array, i.e. two rows, each row having two sets of containers, in which case, a larger capping arrangement may be required. Alternatively, the container arrangement 100 may comprise other suitable configurations of the sets 101 of nested containers 10.

In a further modification, the relative heights of the ribs 52 at different portions of the lid arrangements 16 can be varied. For example, in FIG. 7, the ribs 52 are shown being of a greater height in the third lid portion 36 than in the second lid portion. In FIG. 13 the lid arrangements 16, 16F of two nested containers are shown in their respective open positions aligned with each other. In the modification shown in FIG. 13, the ribs 52, 52F in the first lid portions 30, 30F have a greater height than the ribs 52, 52F in the second lid portions 34, 34F.

The invention claimed is:

1. A container arrangement comprising: first and second containers, wherein each of the first and second containers comprises a base, upstanding walls on the base and a lid arrangement pivotally attached to at least one of the walls at a hinge, the lid arrangement being pivotally rotatable about the hinge from a closed position to an open position; wherein when the lid arrangement of the first container is in the open position, the second container can be nested within the first container; wherein the lid arrangement of each container is configured so that when the containers are nested and when the lid arrangement of the second container is in the open position, the lid arrangement of the second container is aligned with the lid arrangement of the first container;

wherein each lid arrangement comprises side regions extending from the hinge, each side region comprising:

a first side portion, said first side portion extending along a first of the upstanding walls when the lid arrangement is in the closed position; and a second side portion, said second side portion extending along said first upstanding wall when the lid arrangement is in the closed position;

a shoulder formation provided between the first and second side portions, the first side portion being offset inwardly from the second side portion; and wherein the first side portion extends from the free edge of the lid arrangement to the shoulder formation, and the second side portion extends from the shoulder formation to the hinge;

wherein each lid arrangement includes a respective wall member at each side region, the shoulder formation being provided on the wall member, wherein the wall member comprises first and second wall portions offset from each other on opposite sides of the shoulder formation, the first wall portion extending from the free edge to the shoulder formation and the second wall portion extending from the shoulder to the hinge.

2. A container arrangement according to claim 1, wherein each container defines an open position footprint; and wherein the lid arrangement of each container is configured so that when the containers are nested and when the lid arrangement of the second container is in the open position, the open position footprint of the container arrangement is equal to the open position footprint of the first container.

3. A container arrangement according to claim 1, wherein when so nested, the lid arrangement of the second container can be rotated about the hinge from a closed position by an opening angle to the open position, said opening angle being at least 265°.

4. A container arrangement according to claim 3, wherein the opening angle is at least 270°.

5. A container arrangement according to claim 1, wherein each lid arrangement comprises a main member having opposite side regions, each side region extending from the hinge, and a wall member extending along each side region of the main member, the main member being configured to extend across the open top of the container when the lid arrangement is in the closed position; and wherein when so nested, and when the lid arrangement of the second container is in the open position, at least a portion of the main member of the lid arrangement of the second container can be received between the wall members of the lid arrangement of the first container.

6. A container arrangement according to claim 1, wherein the lid arrangement of the second container can be received within the lid arrangement of the first container in a nested condition of the lid arrangements.

7. A container arrangement according to claim 1, wherein each container comprises first and second opposite upstanding walls, and two lid arrangements, each lid arrangement being pivotally attached by respective hinges to the first and second upstanding walls of the container.

8. A container arrangement according to claim 1, wherein the first wall portion is offset inwardly from the second wall portion, whereby the first wall portion of the lid arrangement of the second container is disposed inwardly of the second wall portion of the lid arrangement of the first container when the lid arrangements are nested within each other.

9. A container arrangement, comprising: first and second containers, wherein each of the first and second containers comprises a base, upstanding walls on the base and a lid arrangement pivotally attached to at least one of the walls at a hinge, the lid arrangement being pivotally rotatable about the hinge from a closed position to an open position; wherein when the lid arrangement of the first container is in the open position, the second container can be nested within the first container; wherein the lid arrangement of each container is configured so that when the containers are nested and when the lid arrangement of the second container is in the open position, the lid arrangement of the second container is aligned with the lid arrangement of the first container;

wherein each lid arrangement comprises side regions extending from the hinge, each side region comprising:

a first side portion, said first side portion extending along a first of the upstanding walls when the lid arrangement is in the closed position; and a second side portion, said second side portion extending along, said first upstanding wall when the lid arrangement is in the closed position;

a shoulder formation provided between the first and second side portions, the first side portion being offset inwardly from the second side portion; and wherein the first side portion extends from the free edge of the lid arrangement to the shoulder formation, and the second side portion extends from the shoulder formation to the hinge;

wherein each lid arrangement comprises a main member having opposite side regions extending from the hinge, each side region having a proximal end adjacent the hinge and a distal end spaced from the hinge, wherein the distal end is offset inwardly relative to the proximal end;

wherein each lid arrangement comprises an accommodating formation, wherein the accommodating formation on the lid arrangement of the second container can accommodate the lid arrangement of the first container, and wherein each lid arrangement includes a strengthening formation, the accommodating formation on the lid arrangement of the second container being configured to accommodate the strengthening formation on the lid arrangement of the first container;

wherein the lid arrangement comprises a main member, and the accommodating formation comprises a step formation provided across the main member and extending lengthwise thereof, wherein each lid arrangement has a free edge spaced from the hinge, and wherein the main member comprises a first lid portion extending from the step formation to the free edge of the lid arrangement, and a second lid portion extending from the step formation towards the hinge, the first lid portion of the second container being offset from the second lid portion of the second container to extend over the strengthening formations of the lid arrangement of the first container;

wherein the main member further includes a second step formation and a third lid portion, the second step formation being provided between the second and third lid portions of the main member, the third lid portion extending from the second step formation towards the hinge, and wherein the second lid portion is offset from the third lid portion, and the second lid portion of the second container can extend over the hinge of the first container.

* * * * *